US009748680B1

(12) United States Patent
Huang et al.

(10) Patent No.: US 9,748,680 B1
(45) Date of Patent: Aug. 29, 2017

(54) MULTIPLE CONTACT POGO PIN

(71) Applicant: Intel Corporation, Santa Clara, CA (US)

(72) Inventors: Mingjing Huang, San Francisco, CA (US); Jacob E. Ben-Poorat, Oakland, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 15/195,245

(22) Filed: Jun. 28, 2016

(51) Int. Cl.
*H01R 13/24* (2006.01)
*H01R 12/71* (2011.01)
*H01R 12/91* (2011.01)

(52) U.S. Cl.
CPC ..... *H01R 12/718* (2013.01); *H01R 12/91* (2013.01); *H01R 13/2421* (2013.01)

(58) Field of Classification Search
CPC ... H01R 12/718; H01R 12/91; H01R 13/2421
USPC ..... 439/66, 482, 700, 824
See application file for complete search history.

(56) References Cited

U.S. PATENT DOCUMENTS 7,264,515 B1 * 9/2007 Rubinstein ..... H01R 13/746 211/85.2
7,458,818 B2 * 12/2008 Kiyofuji ..... G01R 1/07371 324/750.07
8,591,267 B2 * 11/2013 Hemmi ..... G01R 1/06722 439/700
8,936,495 B2 1/2015 Hatch
2010/0248558 A1 9/2010 Yin et al.
2012/0043985 A1 2/2012 Hoffman et al.
2012/0142229 A1 6/2012 Henry et al.
2012/0171907 A1 7/2012 Rathburn
(Continued)

FOREIGN PATENT DOCUMENTS

JP 2013134181 A 7/2013
KR 101154537 B1 6/2012

OTHER PUBLICATIONS

"Minature Kelvin Contact—Dual Pogo Pin Assembly", NSC—National Security Campus, Honeywell, (Oct. 2015), 3 pgs.
(Continued)

*Primary Examiner* — Khiem Nguyen
(74) *Attorney, Agent, or Firm* — Schwegman Lundberg & Woessner, P.A.

(57) ABSTRACT

Disclosed herein are devices and methods for a multiple contact probe. The multiple contact probe may include a first contact interface and a second contact interface. The first contact interface may be electrically isolated from the second contact interface. A plunger assembly may be slidably engaged between the first contact interface and the second contact interface. The plunger assembly may be slidable between an extended configuration and a retracted configuration along a longitudinal direction of the plunger assembly. The plunger assembly may include a first electrical contact and a second electrical contact. The first electrical contact may be in electrical contact with the first contact interface and the second electrical contact may be in electrical contact with the second contact interface. A bias element may be engaged with the plunger assembly, for instance, the bias element may be configured to bias the plunger assembly to the extended configuration.

25 Claims, 9 Drawing Sheets

(56) References Cited

U.S. PATENT DOCUMENTS

2014/0091824 A1 4/2014 Fledell et al.

OTHER PUBLICATIONS

"International Application Serial No. PCT/US2017/027390, International Search Report dated Jun. 27, 2017", 6 pgs.
"International Application Serial No. PCT/US2017/027390, Written Opinion dated Jun. 27, 2017", 11 pgs.

* cited by examiner

MULTIPLE CONTACT POGO PIN

TECHNICAL FIELD

This document pertains generally, but not by way of limitation, to electrical connectors, such as electrical contacts including a bias element.

BACKGROUND

Spring probes, commonly referred to as pogo pins, may be used for making electrical connections between electrical components, such as circuit boards, electronic packages, or other electronic devices. Existing spring probes may include a spring loaded pin configured to telescope within a cylindrical body and also be in electrical contact with the cylindrical body. Accordingly, spring probes may be used to make electrical connections where a distance between electrical components is large or variable. Existing spring probes may include different configurations, such as back-drilled, bias spring, and bias ball configurations. The cylindrical body of the spring probe is often wired or soldered to a first electrical component, such as a first circuit board. To communicate an electrical signal or power signal between a first electrical component and a second electrical component, a tip of the spring loaded pin may be held in contact with a contact pad of the second electrical component by a spring force of the pin. Accordingly, the electrical or power signal may be transferred from the contact pad of the first electrical circuit to the second electrical circuit through the pin and the cylindrical body. In some examples, existing spring probes may be used in conjunction to form a spring probe array or bed of nails for making multiple electrical connections simultaneously.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
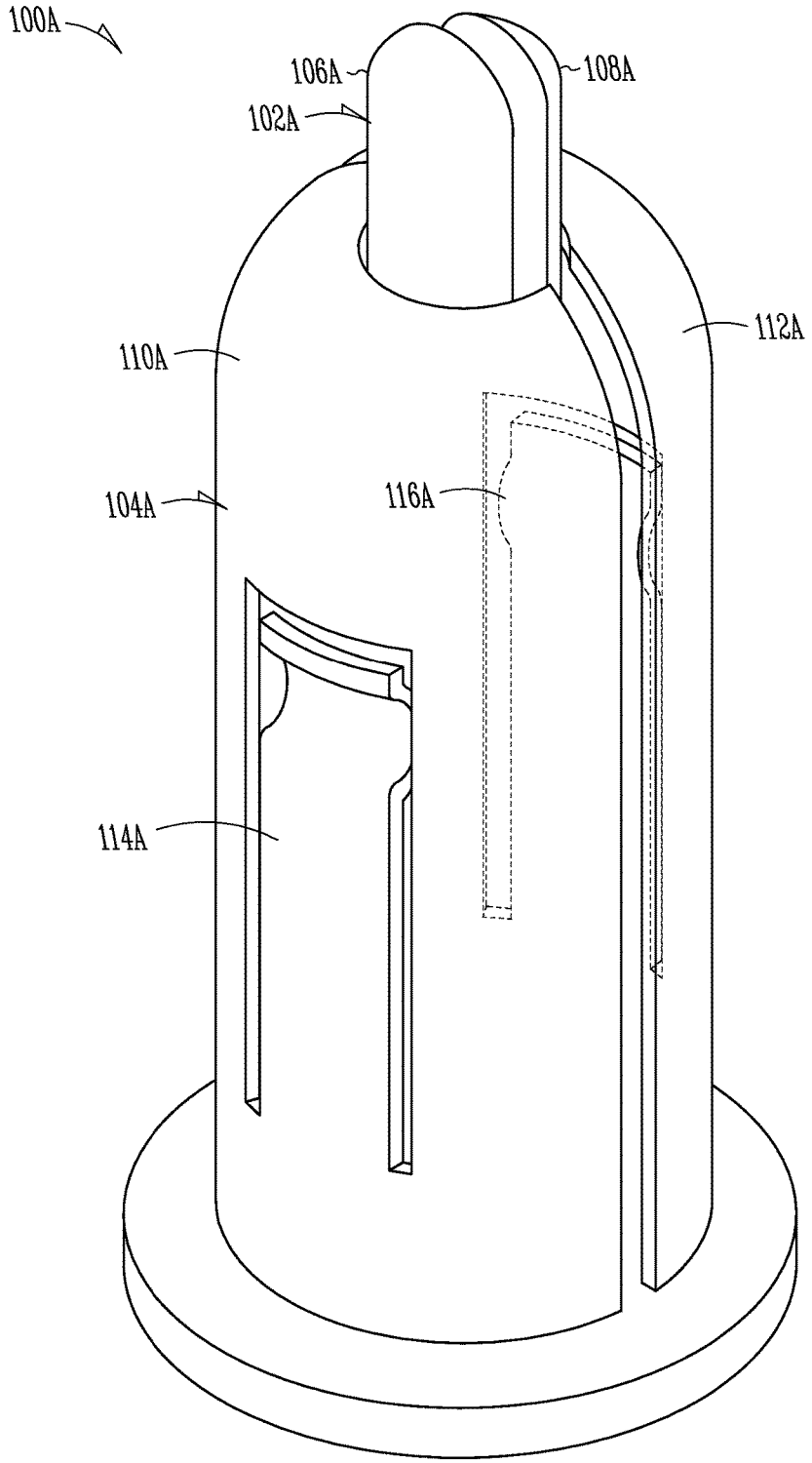
FIG. 1 shows an example of a multiple contact probe including a plunger assembly and a barrel, according to an embodiment.

The present application relates to devices and techniques for a multiple contact probe, such as a multiple contact spring probe. The following detailed description and examples are illustrative of the subject matter disclosed herein; however, the subject matter disclosed is not limited to the following description and examples provided. Portions and features of some embodiments may be included in, or substituted for, those of other embodiments. Embodiments set forth in the claims encompass all available equivalents of those claims.

The present inventors have recognized, among other things, that space within an electronic assembly may be limited, especially as electronic devices continue to become smaller in size. The small size of electronic devices may pose a challenge in making electrical connections between two or more electrical components of the electronic device. For instance, some electrical connectors may require blind mating to reduce the size of the electronic device. Spring probe connectors may reduce alignment difficulties because a relative position of the electrical contacts may be adjusted during a blind mate process. For instance, the electrical contacts do not need to be aligned at the beginning of the connector mating process, because the contact pads that form the electrical contact with the spring probes may be flat thereby allowing the spring probe to translate into alignment across a surface of the contact pad as the spring probe connector is mated. Spring probes may also make electrical connections across gaps between electrical components while occupying a relatively small amount of space on the electrical components because a length of the spring probe is often significantly longer than a width of the spring probe. In addition, the spring element within the spring probe may accommodate variability in the gap dimension between electrical components. For instance, the length of the spring probe may adjust depending on the travel of a translatable plunger within a barrel. However, existing spring probes require a minimum pitch (e.g., center to center spacing) between each adjacent spring probe. This pitch may be greater than some other existing connectors because of the structure required to support the translatable plunger within the barrel of the spring probe. Because each spring probe includes one electrical path of a circuit, a plurality of spring probes may be used to communicate more than one electrical signal simultaneously. However, multiple spring probes may increase the size of an electrical assembly due to the center to center spacing of the spring probes.

The present subject matter may provide a solution to this problem, such as by increasing the number of electrical contacts within a spring probe (or probe including a bias element) to create a multiple contact probe. For instance, a barrel may include or be coupled to a first contact interface and a second contact interface. The first contact interface may be electrically isolated from the second contact interface. A plunger assembly may be slidably coupled to the barrel and slidable between an extended configuration and a retracted configuration along a longitudinal direction of the plunger assembly. In an example, the plunger assembly may include a first electrical contact and a second electrical contact. The first electrical contact may be in electrical contact with the first contact interface and the second electrical contact may be in electrical contact with the second contact interface. The multiple contact probe may further include a bias element located between the barrel and the plunger assembly or between a base member and the plunger assembly. For instance, the bias element may be configured to bias the plunger assembly toward the extended configuration.

Figure 3:
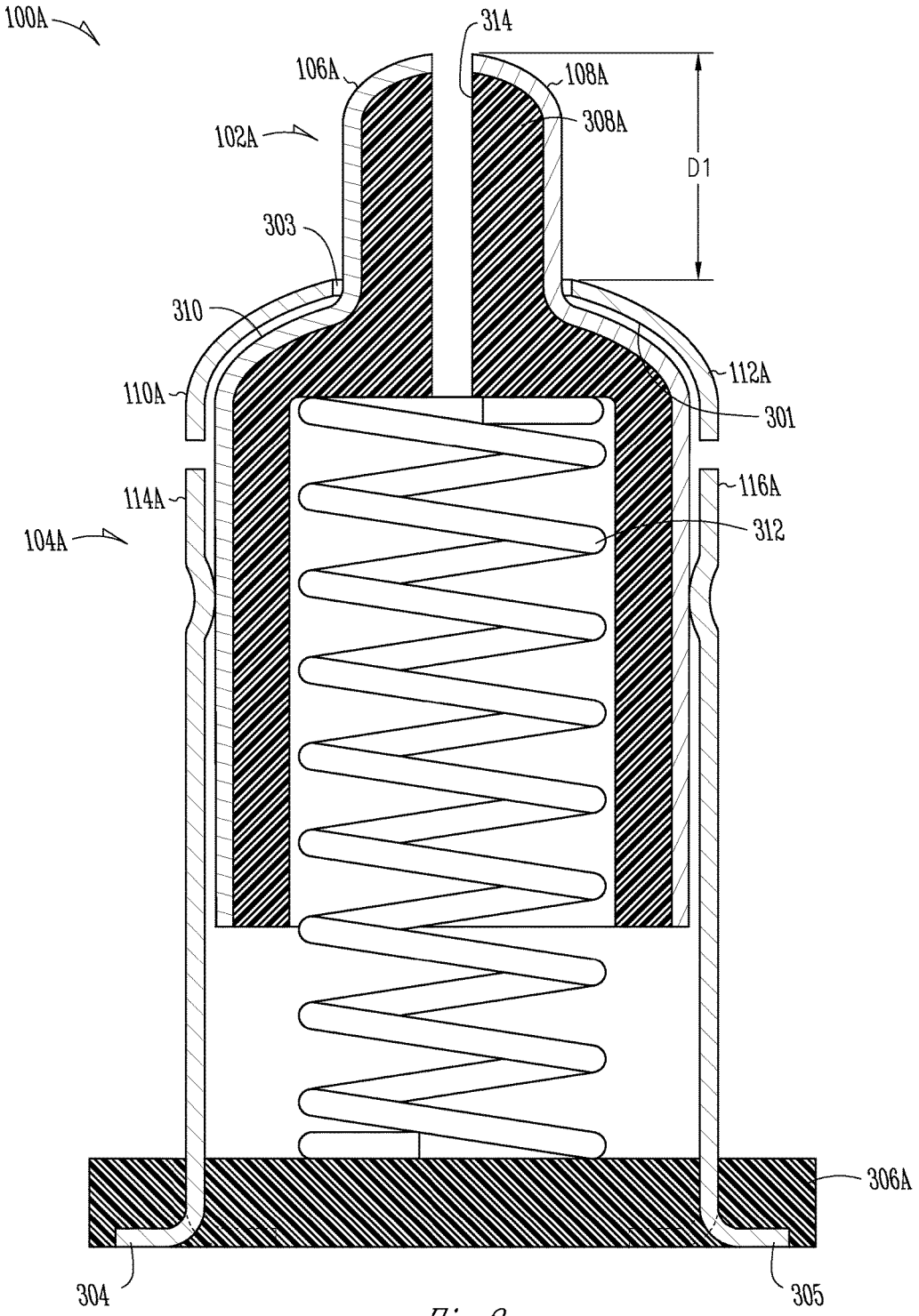
FIG. 3 is a cross section of an exemplary multiple contact probe including the plunger assembly and the barrel, according to an embodiment.
Figure 4:
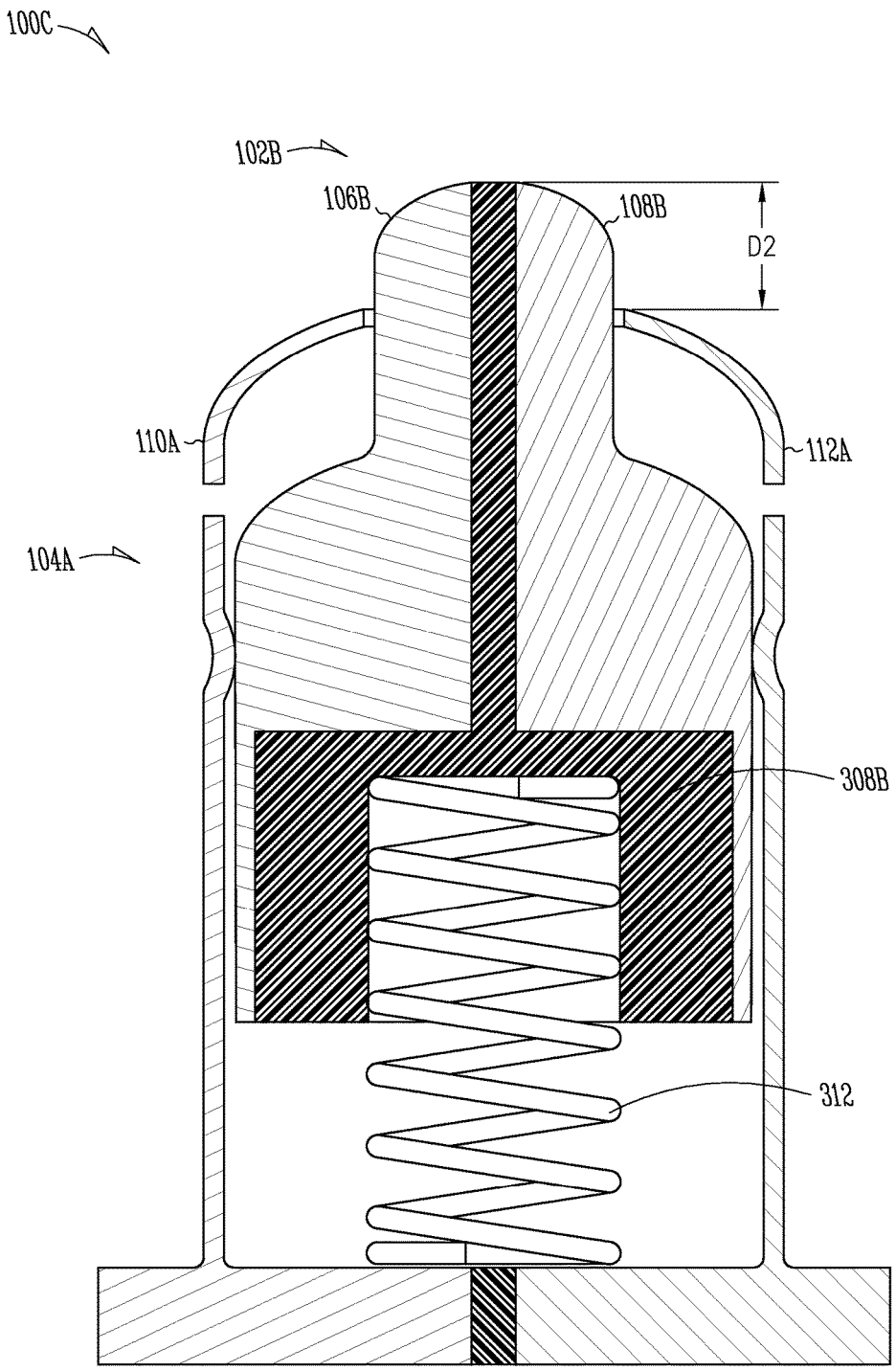
FIG. 4 illustrates an example of the multiple contact probe including the plunger assembly in the retracted configuration, according to an embodiment.

FIG. 1 shows an example of a multiple contact probe 100A including a plunger assembly 102A and a barrel 104A, according to an embodiment. The plunger assembly 102A may be slidably coupled to the barrel 104A. For instance, the plunger assembly 102A may telescope within the barrel 104A. In an example, the plunger assembly 102A may telescope between an extended configuration (as shown in FIG. 3) and a retracted configuration (as shown in FIG. 4). The plunger assembly 102A may include at least two electrical contacts, such as a first electrical contact 106A and a second electrical contact 108A. The first electrical contact 106A and the second electrical contact 108A may be in electrical contact with a respective first contact interface 114A and a respective second contact interface 116A. In other examples, the plunger assembly, such as plunger assembly 102A, may include three, four, five, or other number of electrical contacts. The barrel, such as barrel 104A, can include a number of contact interfaces corresponding to the number of contact interfaces. For instance, the number of contact interfaces can match the number of electrical contacts. The examples herein are not limited by the number of electrical contacts and corresponding contact interfaces shown and described.

In the example of FIG. 1, the first contact interface 114A and the second contact interface 116A may be integral with the barrel 104A. For instance, the barrel 104A may include a plurality of electrically isolated portions corresponding to the number of electrical contacts of the plunger assembly 102A. For example, where the plunger assembly 102A includes the first electrical contact 106A and the second electrical contact 108A, the barrel 104A may include a first portion 110A and a second portion 112A. The first portion 110A may include the first contact interface 114A and the second portion 112A may include the second contact interface 116A. The first portion 110A may be electrically isolated from the second portion 112A. For instance, the first portion 110A and the second portion 112A may be separated by a dielectric including, but not limited to, an air gap, polymer, epoxy, or other. In the example of FIG. 1, the barrel 104A is tubular (e.g., of circular cross section) and the first portion 110A and second portion 112A are semi-cylindrical portions (i.e., semi-tubular) separated by a slot (e.g., air gap) along a longitudinal direction of the barrel 104A. In further examples, the barrel 104A may include other shapes, including but not limited to, rectangular tube, triangular tube, or other shape. A shape of the first portion 110A and second portion 112A may correspond to a shape of the barrel 104A. In an example, the first portion 110A or second portion 112A may be a cantilevered from a base member (as shown, for example, in FIG. 3 and described herein).

Figure 2:
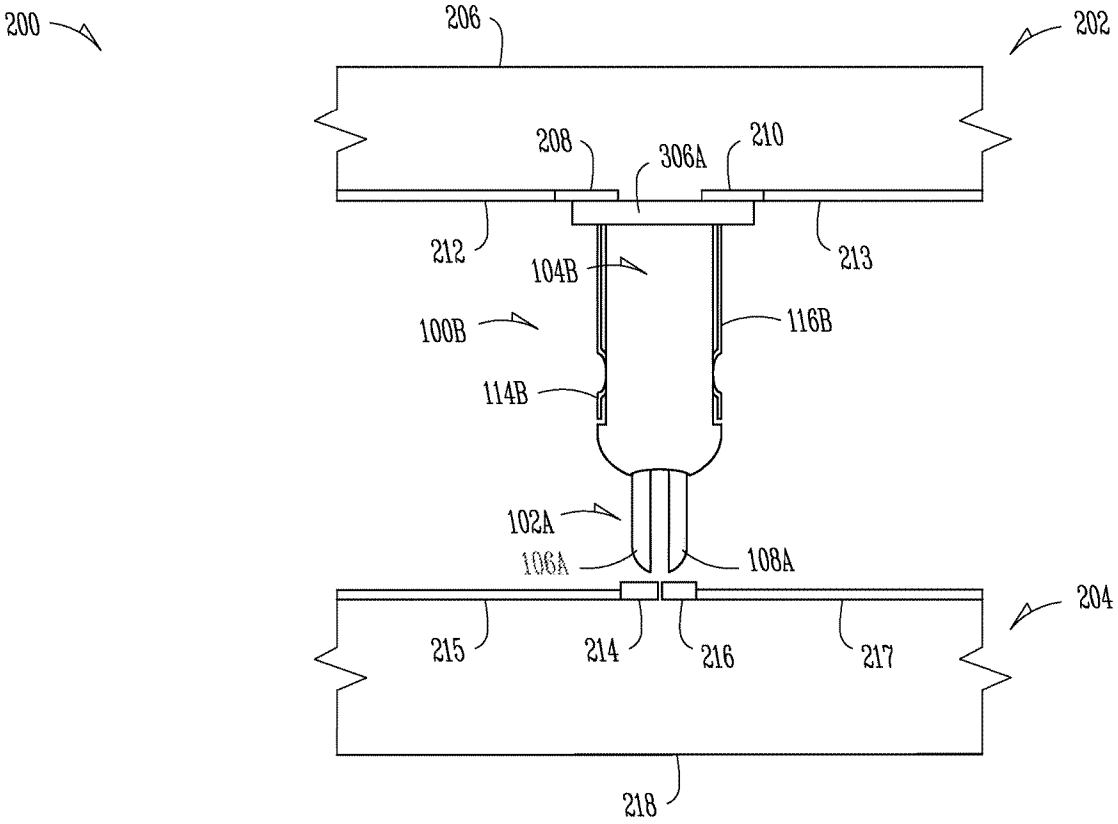
FIG. 2 is an exemplary diagram of an electronic assembly including a first electronic device and a second electronic device, according to an embodiment.

FIG. 2 is an exemplary diagram of an electronic assembly 200 including a first electronic device 202 and a second electronic device 204, according to an embodiment. The multiple contact probe, such as a multiple contact probe 100B may be electrically coupled between the first electronic device 202 and the second electronic device 204. Accordingly, the multiple contact probe 100B may communicate electrical signals between the first electronic device 202 and the second electronic device 204. An electronic device (e.g., the first electronic device 202 or the second electronic device 204) may include, but is not limited to, an electronic package, substrate, a printed circuit board, a printed circuit board assembly, a wire, an electrical contact, processor, memory, antenna, transceiver, or the like. In the example of FIG. 2, the first electronic device 202 may include a first printed circuit board 206 having a first solder pad 208 and a second solder pad 210. The first solder pad 208 and the second solder pad 210 may be coupled to one or more respective electrical circuits, for instance, through one or more traces, such as traces 212 or 213. In other words, the first solder pad 208 may be electrically coupled along a first electrical circuit by the trace 212, and the second solder pad 210 may be electrically coupled along a second electrical circuit by the trace 213.

In an example, the multiple contact probe 100B may be soldered to the first electronic device 202. For instance, the first contact interface, such as first contact interface 114B may be electrically coupled (e.g., soldered) to the first solder pad 208. The second contact interface, such as second contact interface 116B may be electrically coupled to the second solder pad 210. In further examples, the multiple contact probe 100B may be supported by a housing or a bracket, such as press-fit within the housing or bracket. The multiple contact probe 100B may be electrically coupled to the first electronic device 202 by wires, connectors, spring contacts, or the like.

As shown in the example of FIG. 2, the first contact interface 114B and the second contact interface 116B may be independent of the barrel 104B. For instance, the first contact interface 114B and the second contact interface 116B may be coupled to a base member 306A. In one example, the first contact interface 114B and the second contact interface 116B can be insert molded into to the base member 306A. The barrel 104B can be electrically isolated from the first contact interface 114B and the second contact interface 116B.

The second electrical device 204 may include a first contact pad 214 and a second contact pad 216. The first contact pad 214 may be electrically isolated from the second contact pad 216. In an example, the second electrical device 204 may include a second printed circuit board 218. The second printed circuit board 218 may include one or more traces, such as trace 215 or 217 connecting the first contact pad 214 or the second contact pad 216 to one or more respective electrical circuits. For instance, the first contact pad 214 may be electrically coupled along the first electrical circuit by the trace 215 and the second contact pad 216 may be electrically coupled along the second electrical circuit by the trace 217.

The first electrical contact 106A may be in electrical contact with the first contact pad 214 and the second electrical contact 208 may be in contact with the second contact pad 216. Accordingly, the multiple contact probe 100B may be configured to communicate a first electrical signal (or a first electrical power) and a second electrical signal (or a second electrical power) between the first electronic device 202 and the second electronic device 204. For instance, the first electronic signal may propagate along the trace 215 to the first contact pad 214 into the first electrical contact 106A, then to the first contact interface 114B into the first solder pad 208 and along the trace 212. The second electronic signal may propagate along the trace 217 into the second contact pad 216 into the second electrical contact 108A, then to the second contact interface 116B into the second solder pad 210 and along the trace 213.

A distance between the first electronic device 202 and the second electronic device 204 may be a substantial length of the multiple contact probe 100B in the extended configuration (e.g., 99% of the length of the extended configuration), a length of the multiple contact probe 100B in the retracted configuration, or any length in between. In one example, the distance between the first electronic device 202 and the second electronic device 204 may be half-way between the length of the multiple contact probe 100B in the extended configuration and the length of the multiple contact probe in the retracted configuration. The plunger assembly 102A may translate within the barrel 104B between the extended configuration (e.g., as shown in FIG. 3 and described herein) and the retracted configuration (e.g., as shown in FIG. 4 and described herein) along the longitudinal direction of the plunger assembly 102A depending upon the relative distance between the first electronic device 202 and the second electronic device 204.

FIG. 3 is a cross section of an example of the multiple contact probe 100A including the plunger assembly 102A and the barrel 104A as previously described herein, according to an embodiment. The plunger assembly 102A is shown in the extended configuration in the example of FIG. 3. For instance, in the extended configuration, a distal end of the plunger assembly 102A may be extended from a distal portion of the barrel 104A at a first distance D1. Stated another way, a proximal end of the plunger assembly 102A may be located adjacent to the distal portion of the barrel 104A and a distal end of the plunger assembly 102A may be extended from the distal portion of the barrel 104A. A stop feature 301 may be located on the distal portion of the barrel 104A. For instance, an aperture 303 may be located on the distal portion of the barrel 104A. The aperture 303 may include a smaller width than a width of the barrel 104A. Where the plunger assembly 102A is in the retracted configuration (as shown in FIG. 4, for example, and described herein), the distal end of the plunger assembly 102A may be located at a second distance D2 from the distal portion of the barrel 104A. The second distance D2 is shorter than the first distance D1. Stated another way, the proximal end of the plunger assembly 102A may be located adjacent to a proximal portion of the barrel 104A. A channel between the first portion 110A and the second portion 112A of the barrel 104A may be configured to facilitate the plunger assembly 102A translating or sliding within the barrel 104A from the extended configuration to the retracted configuration.

The barrel 104A may support the plunger assembly 102A. As previously described, the barrel 104A may include the first portion 110A and the second portion 112A. The first portion 110A may include the first contact interface 114A and the second portion 112A may include the second contact interface 116A. In the example of FIG. 3, the first contact interface 114A may slide along the first electrical contact 106A and the second contact interface 116A may slide along the second electrical contact 108A. For instance, the first contact interface 114A or the second contact interface 116A may include a respective leaf spring contact. The respective leaf spring contacts may include a cantilevered member having a respective first interface portion and a respective second interface portion. The respective first interface portions may be attached to the barrel 104A, such as the first portion 110A or the second portion 112A respectively. The respective second interface portions may be biased to engage the electrical contact, such as the first electrical contact 106A or the second electrical contact 108A respectively. The plurality of portions of the barrel 104A (e.g., the first portion 110A or the second portion 112A) may be constructed from a material including, not limited to, steel, copper, nickel, gold, bronze, beryllium copper, or the like. Accordingly, the first contact interface 114A and the second contact interface 116A may be in electrical contact with the respective first electrical contact 106A and second electrical contact 108A and may be configured for communicating the first electrical signal and the second electrical signal through the multiple contact probe 100. In an example, the first electrical signal and the second electrical signal may be communicated through the multiple contact probe 100A simultaneously.

One or more contact interfaces (e.g., the first contact interface 114A or the second contact interface 116A) may be electrically coupled to a device interface, such as device interface 304 or device interface 305 respectively. The device interfaces 304, 305 may make electrical contact with the electronic device (e.g., first electronic device 202). For instance, the device interfaces 304, 305 may be soldered or wired to the electronic device. In an example, the device interfaces 304, 305 may include a solder tab, such as a flange. The solder tab may be oriented laterally from the barrel 104A for surface-mount soldering to the contact pad (e.g., the first contact pad 214 or second contact pad 216 respectively). Optionally, the solder tab cab be oriented medially with respect to the barrel 104A, for example, oriented toward the center of the multiple contact probe 100A. In an example, the device interfaces 304, 305 may include a solder cup for soldering a wire to the first contact interface 114A or the second contact interface 116A respectively.

In a further example, the barrel 104A may include a base member 306A. The base member 306A may support the plurality of barrel portions, including the first portion 110A, the second portion 112A, or both. The base member 306A may include a dielectric material including, but not limited to, nylon, liquid crystal polymer, polyether ether ketone, polyphthalamide, polyimide, polyphenylene sulfide, or the like. In an example the material of the base member 306A may be reinforced with glass fill or fiber fill to increase the mechanical strength or heat resistance. For instance, the material of the base member 306A may be withstand exposed to temperatures up to 300° C. for soldering the multiple contact probe 100 to the first electronics device 202. The first portion 110A or the second portion 112A may be insert molded into the base member 306A. In an example, the base member 306A may separate the first portion 110A from the second portion 112A. Accordingly, the dielectric base member 306A may electrically isolate the first portion 110A and the second portion 112A. In an example, the first contact interface 114A and the second contact interface 116A may be electrically isolated from the barrel 104A. For instance, the first contact interface 114A and the second contact interface 116A may be coupled to and supported by the base member 306A. In an example, the first contact interface 114A and the second contact interface 116A may be insert molded into the base member 306A.

In the example of FIG. 3, the plunger assembly 102A may include the first electrical contact 106A and the second electrical contact 108A (as previously described) as well as a contact isolator 308A. In an example, the shape of the first electrical contact 106A or the second electrical contact 108A may include an arcuate or semi-circular profile along the longitudinal direction as show in the Example of FIG. 3. The first electrical contact 106A or the second electrical contact 108A may include a shoulder 310. The shoulder 310 may include a width that is greater than the width of the aperture 303. The bias element 312 may be configured to bias the plunger assembly 102A toward the extended configuration. In the extended configuration, the shoulder 310 may engage the stop feature 301. In the retracted configuration, a proximal end of the plunger assembly 102A may engage with the base member 306A. Accordingly, the plunger assembly 102A may be slidable between the extended configuration and the retracted configuration. The first electrical contact 106A may be in slidable electrical contact with the first contact interface 114A. The second electrical contact 108A may be in slidable electrical contact along the second contact interface 116A.

The electrical contact (e.g., the first electrical contact 106A or the second electrical contact 108A) may be constructed from a material including, but not limited to, steel, copper, nickel, gold, bronze, beryllium copper, or the like. For instance, the first electrical contact 106A or the second electrical contact 108A may include a metal sheet formed (e.g., stamped) into the shape previously described. The first electrical contact 106A and the second electrical contact 108A may be arranged on opposing sides of the plunger assembly 102A to form a cavity between the first electrical contact 106A and the second electrical contact 108A. In an example, the contact isolator 308A may be located in the cavity.

The first electrical contact 106A and the second electrical contact 108A may be configured to make electrical contact with the respective first contact pad 214 or second contact pad 216. For instance, the two or more electrical contacts (e.g., the first electrical contact 106A or the second electrical contact 108A) may include a rounded or pointed shape at the distal end of the respective electrical contact to decrease the contact resistance between the two or more electrical contacts and the respective contact pads (e.g., the first contact pad 214 or second contact pad 216). In an example, the shape of the distal end of the first electrical contact 106A or second electrical contact 108A may include a shape configured to increase a separation distance between the distal end of the first electrical contact 106A and the distal end of the second electrical contact 108A. Increasing the separation distance may increase the positional tolerance between the alignment of the multiple contact probe 100A with the first contact pad 214 and the second contact pad 216 and may help mitigate loss of electrical contact.

The contact isolator 308A may electrically isolate the first electrical contact 106A from the second electrical contact 108A and support the first electrical contact 106A and the second electrical contact 108A on the plunger assembly 102A. For instance, the first electrical contact 106A or the second electrical contact 108A may be coupled to the electrical isolator 308A. In an example, the first electrical contact 106A and the second electrical contact 108A may be fixably attached to the electrical isolator 308A. Accordingly, the first electrical contact 106A, the second electrical contact 108A, and the contact isolator 308A may translate in unison along the longitudinal direction of the plunger assembly 102A with respect to the barrel 104A. In an example, the contact isolator 308A may be fixed in position with respect to the barrel 104A and the first electrical contact 106A and the second electrical contact 108A may translate with respect to the barrel 104A. The contact isolator 308A may be constructed of a material including, but not limited to, a dielectric material including, but not limited to, nylon, liquid crystal polymer, polyether ether ketone, polyphthalamide, polyimide, polyphenylene sulfide, or the like. Accordingly, the contact isolator 308A may provide at least two electrically isolated contacts for communicating a first electrical signal and a second electrical signal.

In an example, the first electrical contact 106A and the second electrical contact 108A may be cut from a single piece of material. For instance, the single piece of material may be mounted to the contact isolator 308A. Then, a slot 314 may be created on the distal end of the plunger assembly 102A as shown in FIG. 3. For instance, the slot 314 may be cut, machined, laser cut, or otherwise formed in the distal end of the plunger assembly 102A. The slot 314 may separate the electrical contact into the first electrical contact 106A and the second electrical contact 108A and may electrically isolate the first electrical contact 106A from the second electrical contact 108A.

In the example of FIG. 3, the bias element 312 may be located between the contact isolator 308A and the base member 306A. In a further example, the bias element 312 may be located between the contact isolator 308A and the barrel 104A. For instance, where the barrel 104A is independent and electrically isolated from the first contact interface 114A and the second contact interface 116A. As previously discussed, the bias element 312 may be configured to bias the plunger assembly 102A toward the extended configuration. The bias element 312 may include, but is not limited to, a coil spring, compression spring, leaf spring, elastomer, or the like.

FIG. 4 illustrates an example of the multiple contact probe 100C including the plunger assembly 102B in the retracted configuration, according to an embodiment. As previously described, in the retracted configuration, the distal end of the plunger assembly 102B may be located at a second distance D2 from the distal portion of the barrel 104A. The second distance D2 being less than the first distance D1 of the extended configuration. The first electrical contact 106B and the second electrical contact 108B may include a semi-cylindrical shape, such as a solid semi-cylindrical shape rather than a hollow semi-cylindrical shape having a concave cavity on one side (as shown in FIG. 3). The distal end of the first electrical contact 106B or the second electrical contact 108B may include a pointed or rounded shape as previously described. As shown in the example of FIG. 4, the contact isolator 308B may be located between the first electrical contact 106B and the second electrical contact 108B and extend from the distal end to the proximal end of the plunger assembly 102B. For instance, the contact isolator 308B may include a strip or a sheet of dielectric material between the first electrical contact 106B and the second electrical contact 108B.

In an example, the first portion 110A or second portion 112A may include a platform of conductive material for soldering the first portion 106B or the second portion 108B to the respective first solder pad 208 or second solder pad 210. A dielectric may be located between the first portion 110A and the second portion 112A, such as between the platform of the respective first portion 110A and the second portion 112A. For instance, the dielectric and the contact isolator 308B may electrically isolate the bias element 312 from at least the first portion 110A or the second portion 112A.

Figure 5:
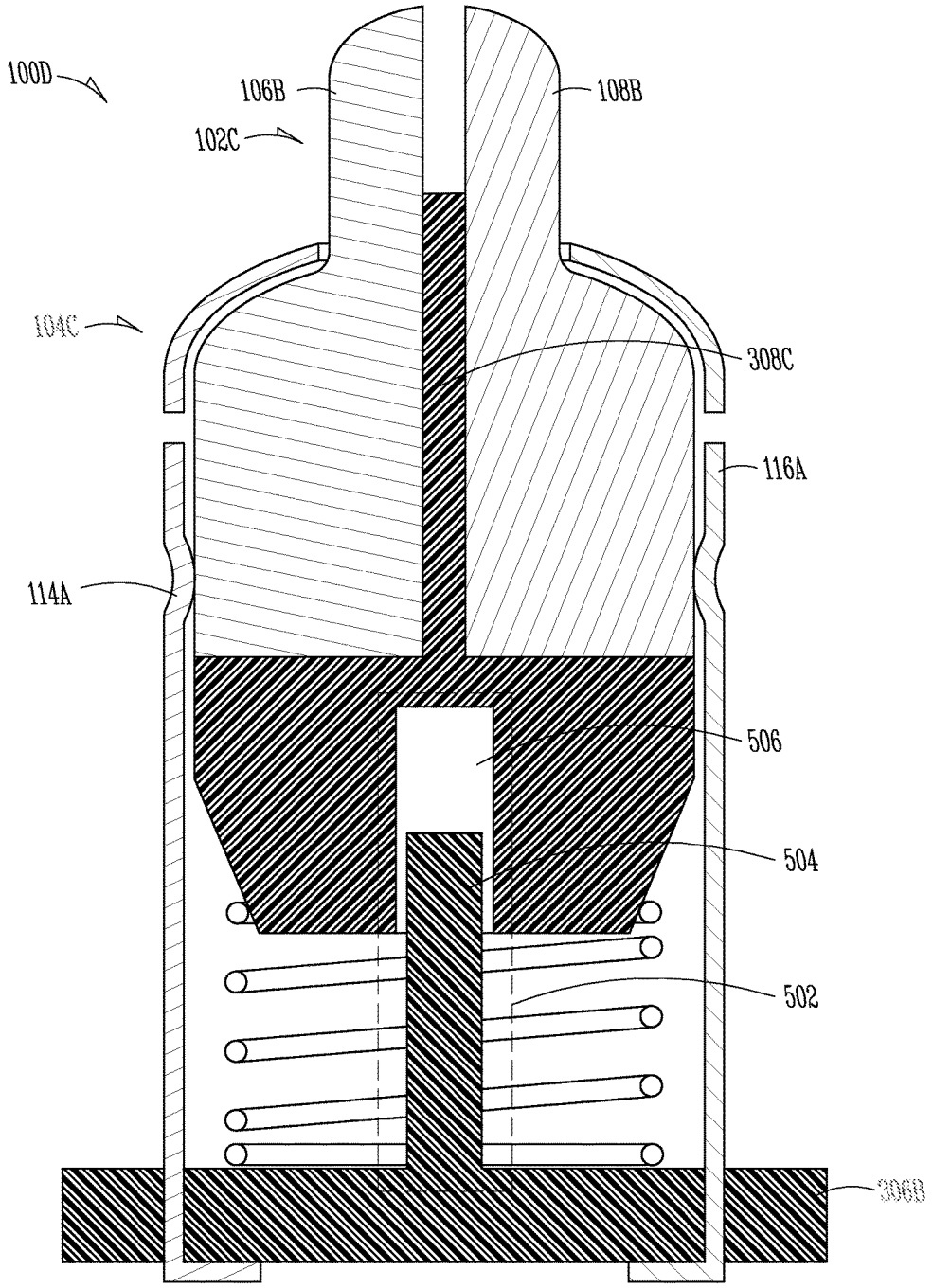
FIG. 5 illustrates an example of a multiple contact probe including an alignment feature, according to an embodiment.

FIG. 5 shows in exemplary multiple contact probe 100D including an alignment feature 502, according to an embodiment. Communication of the first electrical signal between the first electronic device 202 and the second electronic device 204 may be achieved by aligning the first electrical contact 106B with the first contact pad 214 and the first contact interface 114A or aligning the second electrical contact 108B with the second contact pad 216 and the second contact interface 116A. Misalignment during operation or assembly may interfere with the communication of the first electrical signal or the second electrical signal. In an example, alignment between the electrical contacts and the respective contact interfaces may be improved by the alignment feature 502.

The alignment feature 502 may include a barrel alignment feature 504 and a plunger alignment feature 506. Engagement between the barrel alignment feature 504 and the plunger alignment feature 506 may be configured to orient the plunger assembly 102B with respect to the barrel 104C. For instance, in the example of FIG. 5, the plunger alignment feature 506 may include a channel or spline in the contact isolator 308C. The plunger alignment feature 506 may be configured for slidable coupling with the barrel alignment feature 504. For instance, the barrel alignment feature 504 may include a protrusion, such as a boss, shaft, or the like. In an example, the barrel alignment feature 504 may be coupled to, or integral with, the base member 306B. The alignment feature 502 may resist relative rotation between the plunger assembly 102C and the barrel 104C. For instance, the alignment feature 502 may be off-axis from the longitudinal axis of the plunger assembly 102C so the rotation of the plunger assembly 102C along the longitudinal axis with respect to the barrel 104C is limited. In a further example, the barrel alignment feature 506 and the plunger alignment feature 504 may be shaped so the plunger assembly 102C cannot rotate freely with respect to the barrel 104C. For instance, the barrel alignment feature 506 and the plunger alignment feature 504 may be rectangular or triangular so the barrel alignment feature 506 interferes with the plunger alignment feature 504 when the plunger assembly 102C is rotated along the longitudinal axis. Accordingly, the alignment feature 502 may reduce an amount of rotation about the longitudinal axis of the plunger assembly 102C with respect to the barrel 104C. For instance, the alignment feature 502 may align the barrel 104C (e.g., the first contact interface 114A and the second contact interface 116A) with the first contact pad 214 and the second contact pad 216 respectively. Accordingly, the first electrical contact 106B may be configured to be in electrical contact with the first contact pad 214 and the first contact interface 114A, and the second electrical contact 108B may be configured to be in electrical contact with the second contact pad 216 and the second contact interface 116A.

Figure 6:
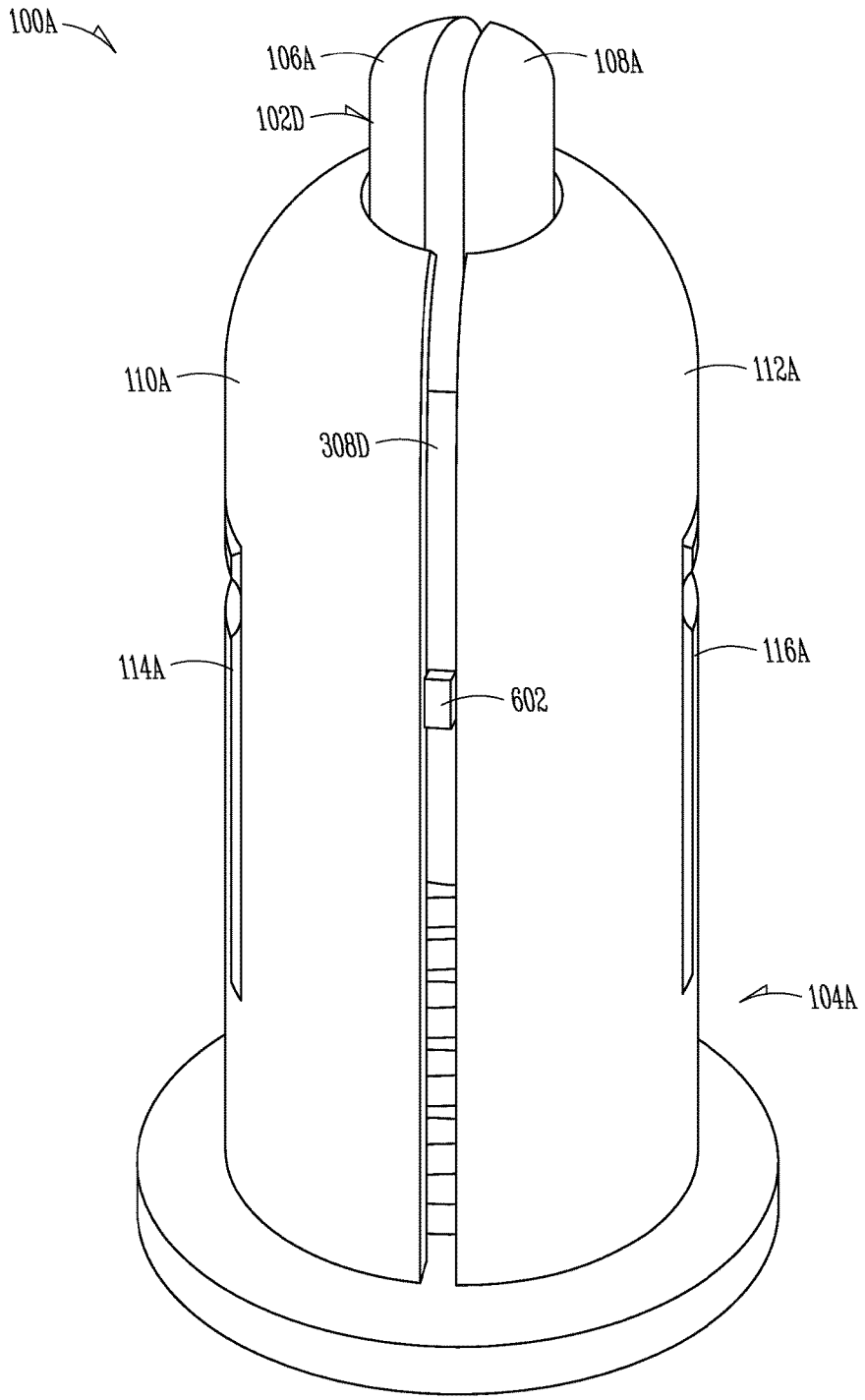
FIG. 6 depicts a further example of a multiple contact probe including an alignment feature, according to an embodiment.

FIG. 6 depicts a further example of a multiple contact probe including an alignment feature, according to an embodiment. In particular, FIG. 6 illustrates an example of alignment feature 602. The alignment feature 602 may be configured to position the orientation of the plunger assembly 102D with respect to the barrel 104A as previously described, for example, with respect to the alignment feature 602. In the example of FIG. 6, the alignment feature 602 may include a projection on the contact isolator 308D. In an example, the alignment feature 602 may translate along a slot between the first portion 110A and the second portion 112A. Accordingly, the first electrical contact 106A may be configured to be in electrical contact with the first contact pad 214 and the first contact interface 114A, and the second electrical contact 108A may be configured to be in electrical contact with the second contact pad 216 and the second contact interface 116A.

In an example, the first electronic device 202, the second electronic device 204, or both may include electronic circuitry or processing configured to detect which contact pad (e.g., first contact pad 214 or second contact pad 216) the first electrical contact 106A or the second electrical contact 108A is electrically coupled with. The electronic circuitry or processing can communicate the first electrical signal or the second electrical signal through either the first electrical contact 106A or the second electrical contact 108A depending on which contact pad the respective electrical contact is electrically coupled to. For instance, the electronic circuitry or processing can transmit the first electrical signal through the second electrical contact 108A if the second electrical contact 108A is electrically coupled to the first contact pad 214 and vice versa.

In a further example, the electrical contacts, such as electrical contact 106A and 108A, and the contact pads, such as the first contact pad 214 and the second contact pad 216, can be magnetized to align the electrical contacts with the respective contact pads. For instance, the first electrical contact 106A can include a first magnetic polarization opposite of a magnetic polarization of the first contact pad 214 for attracting the first electrical contact 106A to the first contact pad 214. Accordingly, the first electrical contact 106A can be aligned with the first contact pad 214 and the second electrical contact 108A can be aligned with the second contact pad 216. For instance, the plunger assembly 102D can rotate in response to the magnetic attraction between the electrical contacts and the contact pads to align the electrical contacts with the respective contact pads.

Figure 7:
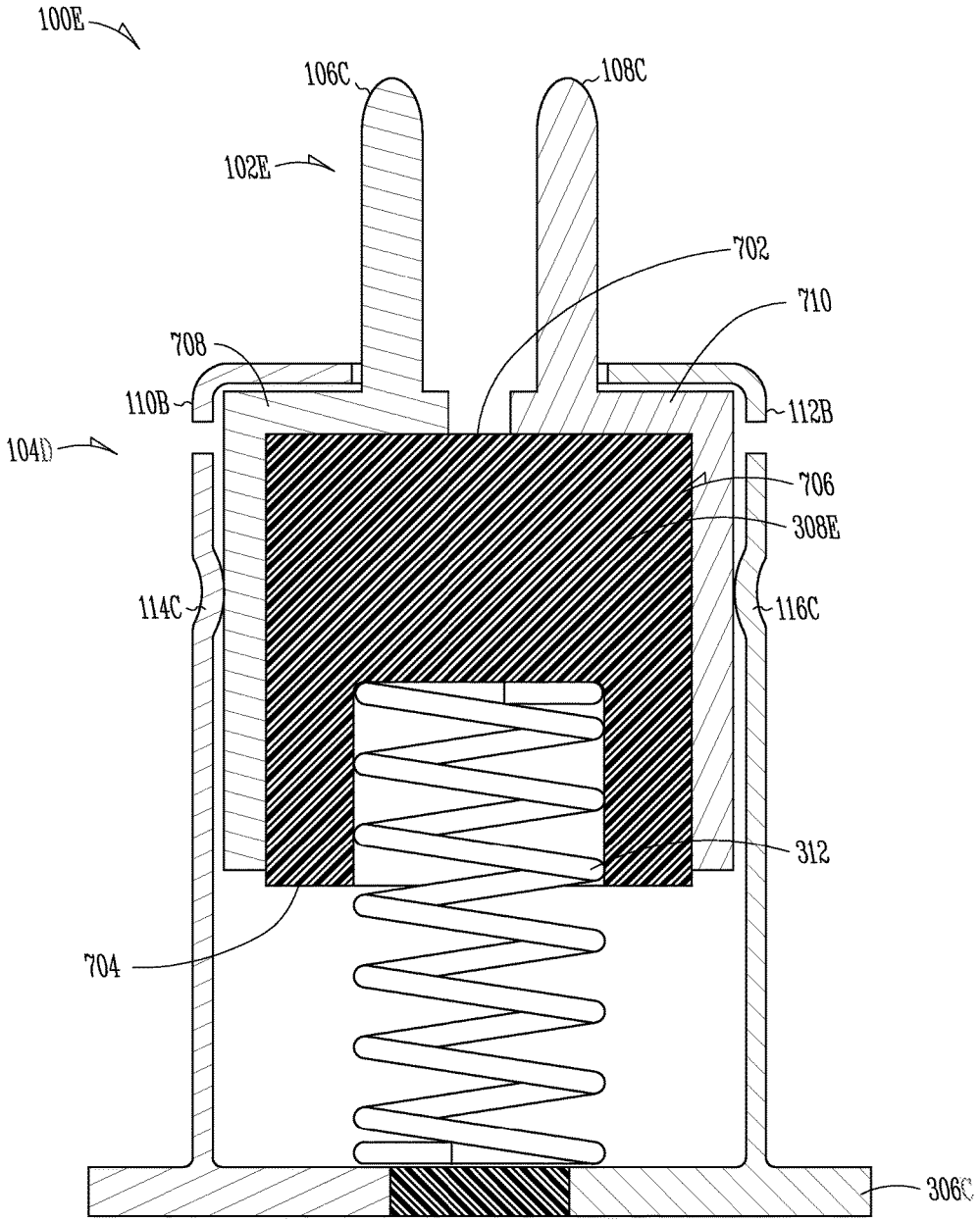
FIG. 7 is a cross section of a further example of a multiple contact probe, according to an embodiment.

FIG. 7 is a cross section of a further example of a multiple contact probe 100E, according to an embodiment. The multiple contact probe 100E may include a first contact interface 110B and a second contact interface 112B as previously described. In the example of FIG. 7, the two or more electrical contacts, such as first electrical contact 106C and second electrical contact 108C, may include an elongate shape. A proximal end of the first electrical contact 106C and a proximal end of the second electrical contact 108C may be coupled to the contact isolator 308C. The contact isolator 308E may include a substantially cylindrical shape having a distal surface 702, a proximal surface 704, and at least one side surface 706. The contact isolator 308E may be slidably engaged between the first portion 110B and the second portion 112B of the barrel 104D along a longitudinal direction of the barrel 104D. The first electrical contact 106C and the second electrical contact 108C may be coupled to the distal surface 702 of the contact isolator 308. The bias element 312 may be located between the contact isolator 308E and the base member 306C as previously described herein.

A conductive element, may electrically couple the one or more electrical contacts to the respective one or more contact interfaces. For example, a first conductive element 708 may electrically couple the first contact interface 114C to the first electrical contact 106C, and a second conductive element 710 may electrically couple the second contact interface 116C to the second contact 108C. For instance, the first conductive element 708 and the second conductive element 710 may be located along the one or more side surfaces 706 of the contact isolator 308E. The first conductive element 708 may be located from the first electrical contact 106C to a location along the contact isolator 308E adjacent to the first contact interface 114C. The second conductive element 710 may be located from the second electrical contact 108C to a location along the contact isolator 308E adjacent to the second contact interface 116C. In an example, the conductive element (conductive element 708 or conductive element 710) may include, but is not limited to, a conductive metal, such as copper, steel, gold, silver, nickel, beryllium copper, or the like. For instance, the conductive element may be formed from sheet metal, machined, laser direct structuring, electroplating, electrical deposition, or other.

Figure 8:
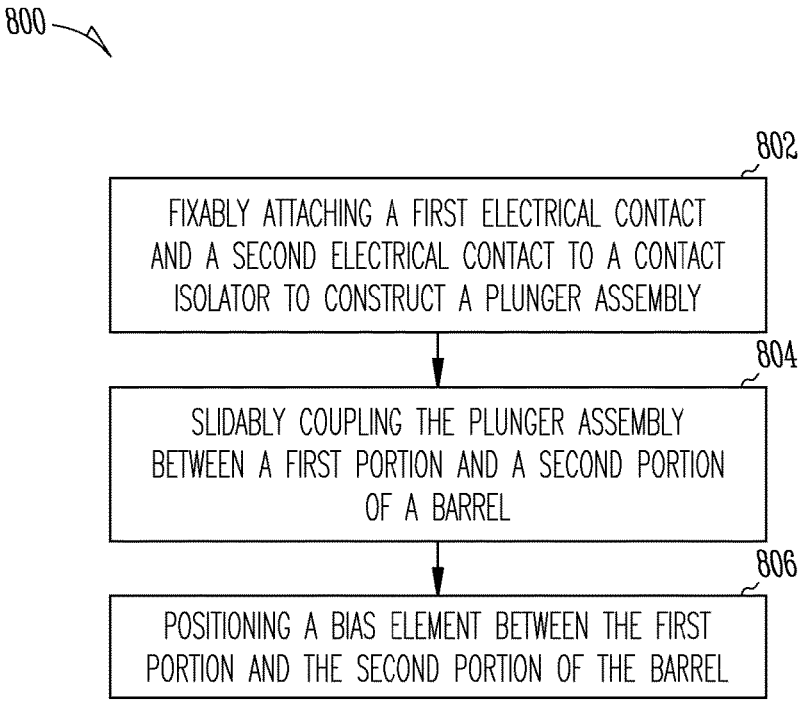
FIG. 8 is a block diagram of an exemplary method of constructing a multiple contact probe, according to an embodiment.

FIG. 8 is a block diagram of an example of a method 800 of constructing a multiple contact probe, such as a multiple contact probe 100A-D or in another example the multiple contact probe 100E as previously described in the examples herein and shown, for instance, in FIGS. 1-7. In describing the method 800, reference is made to one or more components, features, functions, and steps previously described herein. Where convenient, reference is made to the components, features, steps and the like with reference numerals. Reference numerals provided are exemplary and are non-exclusive. For instance, features, components, functions, steps, and the like described in the method 800 include, but are not limited to, the corresponding numbered elements provided herein. Other corresponding features described herein (both numbered and unnumbered) as well as their equivalents are also considered.

At 802, an electrical contact, such as the first electrical contact and the second electrical contact may be fixably attached to the contact isolator to construct a plunger assembly, such as the plunger assembly 102A-E shown and described above and shown in FIGS. 1-7. For instance, the first electrical contact, such as one of the electrical contacts 106A-C and the second electrical contact, such as one of the electrical contacts 108A-C may be insert molded into the contact isolator, such as contact isolator 308A-E.

Where the contact isolator includes a conductive element, such as a first conductive element and a second conductive element, the conductive element may be coupled to (or formed on) the contact isolator by laser direct structuring. In an example, the first conductive element may be the conductive element 708 and the second conductive element may be the conductive element 710, as previously described. In an example, laser direct structuring may include laser activating at least one target surface of the contact isolator with a laser. The contact isolator may include a laser-activatable additive. The laser-activatable additive of the target surface may be activated by the laser for metallization. For instance, the laser may alter the material of the contact isolator including the laser-activatable additive to improve bonding between the target surface and a conductive material (e.g., metallic plating). The conductive material may be metallized on the target surface by electroless plating (or other methods of plating) to form the first conductive element or the second conductive element. In an example, the first electrical contact and the second electrical contact are insert-molded into the contact isolator after laser direct structuring. In an example, the first electrical contact may be electrically coupled to the first conductive element and the second electrical contact may be electrically coupled to the second conductive element by laser direct structuring. In other examples, the first electrical contact and the second electrical contact can be manufactured by a technique including, but not limited to, electro plating, electroless plating, metal injection molding, or other plating or casting process. The first conductive element may be constructed to be electrically isolated from the second conductive element.

At 804, the plunger assembly may be slidably coupled between a first portion and a second portion of the barrel. For instance, the first portion may be first portion 110A, the second portion may be second portion 112A, and the barrel may be barrel 104A as previously shown and described. In an example, the first portion may be arranged opposing the second portion. The plunger assembly, such as plunger assembly 102A may be located between the first portion and the second portion. The plunger assembly and the first and second portions can be sized and arranged with a clearance fit between the plunger assembly and the barrel, such as barrel 104A. Accordingly, the plunger assembly may be translatable between the extended configuration and the retracted configuration. The contact interface can be biased toward the first contact interface and the second electrical contact can be biased toward the second contact interface to make electrical contact between the first electrical contact and the first contact interface and the second electrical contact and the second electrical contact interface respectively.

At 806, a bias element, such as bias element 312 may be positioned between the first portion and the second portion of the barrel. The bias element may be configured to bias the plunger assembly toward the extended configuration as shown, for example, in FIGS. 3, 4, 5, and 7, and described further herein.

Figure 9:
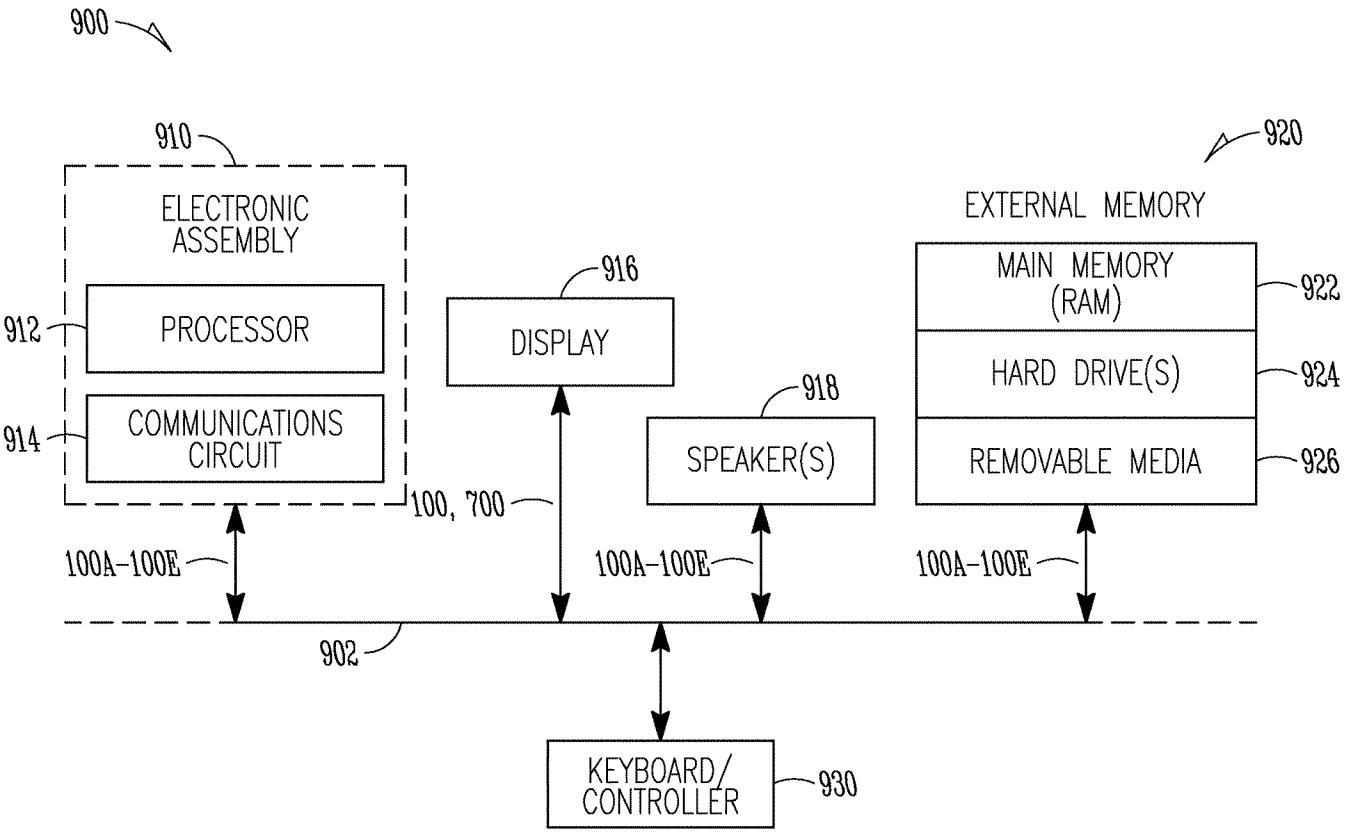
FIG. 9 is block diagram of an electronic system including the multiple contact probe, according to an embodiment.

An example of an electronic system including one or more electronic devices using the multiple contact probe, such as one of the multiple contact probes 100A-E as described in the present disclosure is included to show an example of a higher level device application for the present invention. FIG. 9 is a block diagram of an electronic system 900 incorporating at least one multiple contact probe 100A-E and/or method in accordance with at least one embodiment of the invention. Electronic system 900 is merely an example of an electronic system in which embodiments of the present invention may be used. Examples of electronic systems 900 include, but are not limited to personal computers, tablet computers, mobile telephones, game devices, MP3 or other digital music players, etc. In this example, electronic system 900 comprises a data processing system that includes a system bus 902 to couple the various components of the system. System bus 902 provides communications links among the various components of the electronic system 900 and may be implemented as a single bus, as a combination of busses, or in any other suitable manner. The multiple contact probe as described in any of the examples herein may be coupled between electronic devices or between electronic devices and the system bus 902 of the electronic system 900.

An electronic assembly 910 may be coupled to system bus 902 by the multiple contact probe (e.g., multiple contact probes 100A-E) as described herein. The electronic assembly 910 may include any circuit or combination of circuits. In one embodiment, the electronic assembly 910 includes a processor 912 which may be of any type. As used herein, "processor" means any type of computational circuit, such as but not limited to a microprocessor, a microcontroller, a complex instruction set computing (CISC) microprocessor, a reduced instruction set computing (RISC) microprocessor, a very long instruction word (VLIW) microprocessor, a graphics processor, a digital signal processor (DSP), multiple core processor, or any other type of processor or processing circuit.

Other types of circuits that may be included in the electronic assembly 910 are a custom circuit, an application-specific integrated circuit (ASIC), or the like, such as, for example, one or more circuits (such as a communications circuit 914) for use in wireless devices like mobile telephones, personal data assistants, portable computers, two-way radios, and similar electronic systems. The IC may perform any other type of function. Circuits of the electronic system 900 may be electrically coupled by the multiple contact probe (e.g., multiple contact probes 100A-E) as described herein.

The electronic system 900 may also include an external memory 920, which in turn may include one or more memory elements suitable to the particular application, such as a main memory 922 in the form of random access memory (RAM), one or more hard drives 924, and/or one or more drives that handle removable media 926 such as compact disks (CD), flash memory cards, digital video disk (DVD), and the like.

The electronic system 900 may also include a display device 916, one or more speakers 918, and a keyboard and/or controller 930, which may include a mouse, trackball, touch screen, voice-recognition device, or any other device that permits a system user to input information into and receive information from the electronic system 900.

Various Notes & Examples

Each of these non-limiting examples may stand on its own, or may be combined in various permutations or combinations with one or more of the other examples. To better illustrate the method and apparatuses disclosed herein, a non-limiting list of embodiments is provided here:

Example 1 is a multiple contact probe including a first contact interface and a second contact interface, wherein the first contact interface may be electrically isolated from the second contact interface; a plunger assembly slidably engaged between the first contact interface and the second contact interface, the plunger assembly may be slidable between an extended configuration and a retracted configuration along a longitudinal direction of the plunger assembly, the plunger assembly may include a first electrical contact and a second electrical contact, wherein the first electrical contact may be in electrical contact with the first contact interface and the second electrical contact may be in electrical contact with the second contact interface; and a bias element engaged with the plunger assembly, wherein the bias element is configured to bias the plunger assembly to the extended configuration.

In Example 2, the subject matter of Example 1 optionally includes wherein the first electrical contact and the second electrical contact may be located on opposing sides of the contact isolator.

In Example 3, the subject matter of any one or more of Examples 1-2 optionally include wherein the first contact interface and the second contact interface may be leaf spring contacts.

In Example 4, the subject matter of any one or more of Examples 1-3 optionally include wherein the bias element may be a compression spring.

In Example 5, the subject matter of any one or more of Examples 1-4 optionally include wherein the first electrical contact may be configured to slide along the first contact interface and the second electrical contact may be configured to slide along the second contact interface.

In Example 6, the subject matter of any one or more of Examples 1-5 optionally further include an alignment feature, wherein the alignment feature may be configured to orient the plunger assembly with respect to the first contact interface and the second contact interface.

In Example 7, the subject matter of any one or more of Examples 1-6 optionally include wherein the first electrical contact and the second electrical contact may be coupled to a contact isolator. The contact isolator may be slidable between the first contact interface and the second contact interface along the longitudinal direction of the plunger assembly.

Example 8 is a multiple pole bias-able probe including a barrel having a first portion and a second portion. The first portion may be electrically isolated from the second portion, and the first portion may include a first contact interface and the second portion may include a second contact interface. A plunger assembly may be slidably coupled to the barrel, the plunger assembly may include a first contact coupled to a contact isolator and may be electrically isolated from a second contact coupled to the contact isolator. The plunger assembly may be slidable between an extended configuration and a retracted configuration along a longitudinal direction of the plunger assembly. In the extended configuration, a distal end of the plunger assembly may be extended from a distal portion of the barrel at a first distance. In the retracted configuration, the distal end of the plunger assembly may be located at a second distance from the distal portion of the barrel. The second distance may be shorter than the first distance. A bias element may be located between the barrel and the plunger assembly. The bias element may be configured to bias the plunger assembly to the extended configuration.

In Example 9, the subject matter of Example 8 optionally includes wherein the first electrical contact and the second electrical contact may be located on opposing sides of the contact isolator.

In Example 10, the subject matter of any one or more of Examples 8-9 optionally include wherein the first contact interface and the second contact interface may be a leaf spring contact.

In Example 11, the subject matter of any one or more of Examples 8-10 optionally include wherein the bias element may be a compression spring.

In Example 12, the subject matter of any one or more of Examples 8-11 optionally include wherein the first electrical contact may be configured to slide along the first contact interface and the second electrical contact may be configured to slide along the second contact interface.

In Example 13, the subject matter of any one or more of Examples 8-12 optionally further include an alignment feature including a barrel alignment feature engaged with a plunger alignment feature, wherein the alignment feature may be configured to orient the plunger assembly with respect to the barrel.

In Example 14, the subject matter of any one or more of Examples 8-13 optionally include wherein the first electrical contact and the second electrical contact may be coupled to a contact isolator slidable within the barrel along the longitudinal direction of the plunger assembly.

Example 15 is a system including a first electronic device having a multiple contact probe configured for electrical communication with the electronic device. The multiple contact probe may include a barrel coupled to a first contact interface and a second contact interface. The first contact interface may be electrically isolated from the second contact interface. A plunger assembly may be slidably coupled to the barrel and slidable between an extended configuration and a retracted configuration along a longitudinal direction of the plunger assembly. The plunger assembly may include a first electrical contact and a second electrical contact. The first electrical contact may be in electrical contact with the first contact interface and the second electrical contact may be in electrical contact with the second contact interface. A bias element may be located between the barrel and the plunger assembly. The bias element may be configured to bias the plunger assembly to the extended configuration.

In Example 16, the subject matter of Example 15 optionally includes wherein the first electrical contact and the second electrical contact may be located on opposing sides of the contact isolator.

In Example 17, the subject matter of any one or more of Examples 15-16 optionally include wherein the first contact interface and the second contact interface may be a leaf spring contact.

In Example 18, the subject matter of any one or more of Examples 15-17 optionally include wherein the bias element may be a compression spring.

In Example 19, the subject matter of any one or more of Examples 15-18 optionally include wherein the first electrical contact may be configured to slide along the first contact interface and the second electrical contact may be configured to slide along the second contact interface.

In Example 20, the subject matter of any one or more of Examples 15-19 optionally further include an alignment feature including a barrel alignment feature engaged with a plunger alignment feature, wherein the alignment feature may be configured to orient the plunger assembly with respect to the barrel.

In Example 21, the subject matter of any one or more of Examples 15-20 optionally include wherein the first electrical contact and the second electrical contact may be coupled to a contact isolator slidable within the barrel along the longitudinal direction of the plunger assembly.

Example 22 is a method including fixably attaching a first electrical contact and a second electrical contact to a contact isolator to construct a plunger assembly. The contact isolator may include a first conductive element and a second conductive element coupled to the contact isolator by laser direct structuring. The first electrical contact may be electrically coupled to the first conductive element and the second electrical contact may be electrically coupled to the second conductive element. The method further includes slidably coupling the plunger assembly between a first portion and a second portion of a barrel. The plunger assembly may be translatable between an extended configuration and a retracted configuration. The first electrical contact may be electrically coupled to a first contact interface of the first portion through first conductive element. The second electrical contact may be electrically coupled to a second contact interface of the second portion through the second conductive element. The method further including positioning a bias element between the first portion and the second portion of the barrel. The bias element may be configured to bias the plunger assembly toward the extended configuration.

In Example 23, the subject matter of Example 22 optionally includes wherein the first electrical contact and the second electrical contact may be insert-molded into the contact isolator.

In Example 24, the subject matter of any one or more of Examples 22-23 optionally include wherein the first electrical contact and the second electrical contact may be insert-molded into the contact isolator after laser direct structuring.

In Example 25, the subject matter of any one or more of Examples 22-24 optionally include wherein coupling the first conductive element and the second conductive element to the contact isolator by laser direct structuring may include laser-activating at least one target surface of the contact isolator with a laser. A laser-activatable additive of the target surface may be activated to be metalized by the laser. The method may include metalizing a conductive material on the target surface by electroless plating to form the first conductive element and the second conductive element. The first conductive element may be electrically isolated from the second conductive element.

Example 26 is a multiple contact probe including a first contact interface and a second contact interface. The first contact interface may be electrically isolated from the second contact interface. A plunger assembly may have a means for slidably engaging with the first contact interface and the second contact interface. The plunger assembly may be slidable between an extended configuration and a retracted configuration along a longitudinal direction of the plunger assembly. The plunger assembly may include at least a first electrical contact and a second electrical contact. The plunger assembly may include a means for electrical contact between the first electrical contact and the first contact interface and a means for electrical contact between the second electrical contact and the second contact interface. A bias element may be engaged with the plunger assembly. The bias element may include a means for biasing the plunger assembly toward the extended configuration.

In Example 27, the subject matter of Example 26 optionally includes wherein the first electrical contact and the second electrical contact may be located on opposing sides of the contact isolator.

In Example 28, the subject matter of any one or more of Examples 26-27 optionally include wherein the first contact interface and the second contact interface may be leaf spring contacts.

In Example 29, the subject matter of any one or more of Examples 26-28 optionally include wherein the bias element may be a compression spring.

In Example 30, the subject matter of any one or more of Examples 26-29 optionally include wherein the first electrical contact may be configured to slide along the first contact interface and the second electrical contact may be configured to slide along the second contact interface.

In Example 31, the subject matter of any one or more of Examples 26-30 optionally further include an alignment feature. The alignment feature may be configured to orient the plunger assembly with respect to the first contact interface and the second contact interface.

In Example 32, the subject matter of any one or more of Examples 26-31 optionally include wherein the first electrical contact and the second electrical contact may be coupled to a contact isolator. The contact isolator may be slidable between the first contact interface and the second contact interface along the longitudinal direction of the plunger assembly.

Each of these non-limiting examples may stand on its own, or may be combined in various permutations or combinations with one or more of the other examples.

The above detailed description includes references to the accompanying drawings, which form a part of the detailed description. The drawings show, by way of illustration, specific embodiments in which the invention may be practiced. These embodiments are also referred to herein as "examples." Such examples may include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including"

and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein may be machine or computer-implemented at least in part. Some examples may include a computer-readable medium or machine-readable medium encoded with instructions operable to configure an electronic device to perform methods as described in the above examples. An implementation of such methods may include code, such as microcode, assembly language code, a higher-level language code, or the like. Such code may include computer readable instructions for performing various methods. The code may form portions of computer program products. Further, in an example, the code may be tangibly stored on one or more volatile, non-transitory, or non-volatile tangible computer-readable media, such as during execution or at other times. Examples of these tangible computer-readable media may include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments may be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments may be combined with each other in various combinations or permutations. The scope of the invention should be determined with reference to the appended claims, along with the full scope of equivalents to which such claims are entitled.

What is claimed is:

1. A multiple contact probe comprising:

a first contact interface and a second contact interface, wherein the first contact interface is electrically isolated from the second contact interface;

a plunger assembly slidably engaged between the first contact interface and the second contact interface, the plunger assembly slidable between an extended configuration and a retracted configuration along a longitudinal direction of the plunger assembly, the plunger assembly including a first electrical contact and a second electrical contact, wherein the first electrical contact is in electrical contact with the first contact interface and the second electrical contact is in electrical contact with the second contact interface; and a bias element engaged with the plunger assembly, wherein the bias element is configured to bias the plunger assembly to the extended configuration.

2. The multiple contact probe of claim 1, wherein the first electrical contact and the second electrical contact are located on opposing sides of the contact isolator.

3. The multiple contact probe of claim 1, wherein the first contact interface and the second contact interface are leaf spring contacts.

4. The multiple contact probe of claim 1, wherein the bias element is a compression spring.

5. The multiple contact probe of claim 1, wherein the first electrical contact is configured to slide along the first contact interface and the second electrical contact is configured to slide along the second contact interface.

6. The multiple contact probe of claim 1, further comprising an alignment feature, wherein the alignment feature is configured to orient the plunger assembly with respect to the first contact interface and the second contact interface.

7. The multiple contact probe of claim 1, wherein the first electrical contact and the second electrical contact are coupled to a contact isolator, wherein the contact isolator is slidable between the first contact interface and the second contact interface along the longitudinal direction of the plunger assembly.

8. A multiple pole bias-able probe comprising:

a barrel including a first portion and a second portion, wherein the first portion is electrically isolated from the second portion, and the first portion includes a first contact interface and the second portion includes a second contact interface;

a plunger assembly slidably coupled to the barrel, the plunger assembly including a first contact coupled to a contact isolator and electrically isolated from a second contact coupled to the contact isolator, wherein the plunger assembly is slidable between an extended configuration and a retracted configuration along a longitudinal direction of the plunger assembly, including:

in the extended configuration, a distal end of the plunger assembly is extended from a distal portion of the barrel at a first distance, and in the retracted configuration, the distal end of the plunger assembly is located at a second distance from the distal portion of the barrel, wherein the second distance is shorter than the first distance; and a bias element located between the barrel and the plunger assembly, wherein the bias element is configured to bias the plunger assembly to the extended configuration.

9. The multiple pole bias-able probe of claim 8, wherein the first electrical contact and the second electrical contact are located on opposing sides of the contact isolator.

10. The multiple pole bias-able probe of claim 8, wherein the first contact interface and the second contact interface are a leaf spring contact.

11. The multiple pole bias-able probe of claim 8, wherein the bias element is a compression spring.

12. The multiple pole bias-able probe of claim 8, wherein the first electrical contact is configured to slide along the first contact interface and the second electrical contact is configured to slide along the second contact interface.

13. The multiple pole bias-able probe of claim 8, further comprising an alignment feature including a barrel alignment feature engaged with a plunger alignment feature, wherein the alignment feature is configured to orient the plunger assembly with respect to the barrel.

14. The multiple pole bias-able probe of claim 8, wherein the first electrical contact and the second electrical contact are coupled to a contact isolator slidable within the barrel along the longitudinal direction of the plunger assembly.

15. A system comprising:

a first electronic device including a multiple contact probe configured for electrical communication with the electronic device, wherein the multiple contact probe includes:

a barrel coupled to a first contact interface and a second contact interface, wherein the first contact interface is electrically isolated from the second contact interface;

a plunger assembly slidably coupled to the barrel and slidable between an extended configuration and a retracted configuration along a longitudinal direction of the plunger assembly, the plunger assembly including a first electrical contact and a second electrical contact, wherein the first electrical contact is in electrical contact with the first contact interface and the second electrical contact is in electrical contact with the second contact interface; and a bias element located between the barrel and the plunger assembly, wherein the bias element is configured to bias the plunger assembly to the extended configuration;

a second electronic device including a first contact pad and a second contact pad, wherein the first contact pad is configured to align with the first electrical contact and the second contact pad is configured to align with the second electrical contact.

16. The system of claim 15, wherein the first electrical contact and the second electrical contact are located on opposing sides of the contact isolator.

17. The system of claim 15, wherein the first contact interface and the second contact interface are a leaf spring contact.

18. The system of claim 15, wherein the bias element is a compression spring.

19. The system of claim 15, wherein the first electrical contact is configured to slide along the first contact interface and the second electrical contact is configured to slide along the second contact interface.

20. The system of claim 15, further comprising an alignment feature including a barrel alignment feature engaged with a plunger alignment feature, wherein the alignment feature is configured to orient the plunger assembly with respect to the barrel.

21. The system of claim 15, wherein the first electrical contact and the second electrical contact are coupled to a contact isolator slidable within the barrel along the longitudinal direction of the plunger assembly.

22. A method comprising:

fixably attaching a first electrical contact and a second electrical contact to a contact isolator to construct a plunger assembly, wherein the contact isolator includes a first conductive element and a second conductive element coupled to the contact isolator by laser direct structuring, and the first electrical contact is electrically coupled to the first conductive element and the second electrical contact is electrically coupled to the second conductive element;

slidably coupling the plunger assembly between a first portion and a second portion of a barrel, wherein the plunger assembly is translatable between an extended configuration and a retracted configuration, and wherein the first electrical contact is electrically coupled to a first contact interface of the first portion through first conductive element, and the second electrical contact is electrically coupled to a second contact interface of the second portion through the second conductive element; and positioning a bias element between the first portion and the second portion of the barrel, wherein the bias element is configured to bias the plunger assembly toward the extended configuration.

23. The method of claim 22, wherein the first electrical contact and the second electrical contact are insert-molded into the contact isolator.

24. The method of claim 23, wherein the first electrical contact and the second electrical contact are insert-molded into the contact isolator after laser direct structuring.

25. The method of claim 22, wherein coupling the first conductive element and the second conductive element to the contact isolator by laser direct structuring includes:

laser-activating at least one target surface of the contact isolator with a laser, wherein a laser-activatable additive of the target surface is activated to be metalized by the laser; and metalizing a conductive material on the target surface by electroless plating to form the first conductive element and the second conductive element, wherein the first conductive element is electrically isolated from the second conductive element.

* * * * *